US006722449B2

(12) United States Patent
Lebisch et al.

(10) Patent No.: US 6,722,449 B2
(45) Date of Patent: Apr. 20, 2004

(54) MACHINE TOOL WITH A CHAMBER FOR LUBRICANT AGENT AND A PRESSURE EQUALIZATION DEVICE FOR SAID CHAMBER

(75) Inventors: Helmut Lebisch, Stuttgart (DE); Otto Baumann, Leinfelden-Echterdingen (DE); Rolf Mueller, Leinfelden-Echterdingen (DE); Dietmar Saur, Gomaringen (DE)

(73) Assignee: Robert Bosch GmbH, Stuttgart (DE)

( * ) Notice: Subject to any disclaimer, the term of this patent is extended or adjusted under 35 U.S.C. 154(b) by 70 days.

(21) Appl. No.: 10/130,240

(22) PCT Filed: Aug. 31, 2001

(86) PCT No.: PCT/DE01/03358

§ 371 (c)(1),
(2), (4) Date: Jul. 31, 2002

(87) PCT Pub. No.: WO02/22315

PCT Pub. Date: Mar. 21, 2002

(65) Prior Publication Data

US 2003/0121683 A1 Jul. 3, 2003

(30) Foreign Application Priority Data

Sep. 15, 2000 (DE) ..... 100 45 618

(51) Int. Cl.[7] ..... E21B 10/24
(52) U.S. Cl. ..... 173/213; 173/216; 184/64
(58) Field of Search ..... 173/104, 213, 173/216, DIG. 3, 171; 184/64, 102, 106; 192/105 B

(56) References Cited

U.S. PATENT DOCUMENTS

| | | | | | |
|---|---|---|---|---|---|
| 1,956,644 | A | * | 5/1934 | Hamerly | 184/55.1 |
| 3,162,268 | A | * | 12/1964 | Short | 184/5 |
| 3,946,490 | A | * | 3/1976 | Sotman et al. | 433/82 |
| 4,183,414 | A | * | 1/1980 | Tamai et al. | 173/118 |
| 4,403,679 | A | * | 9/1983 | Snider | 184/64 |
| 4,497,380 | A | | 2/1985 | Flack et al. | |
| 5,293,959 | A | * | 3/1994 | Kimberlin | 184/6.14 |
| 5,385,512 | A | * | 1/1995 | Moolenaar et al. | 475/153 |
| 5,437,356 | A | * | 8/1995 | Lohr | 192/105 BA |
| 5,450,925 | A | * | 9/1995 | Smith et al. | 184/5 |
| 5,738,177 | A | * | 4/1998 | Schell et al. | 173/178 |
| 6,109,366 | A | * | 8/2000 | Jansson et al. | 173/216 |

FOREIGN PATENT DOCUMENTS

| | | |
|---|---|---|
| DE | 42 31 987 | 3/1994 |
| EP | 0 489 277 | 6/1992 |
| GB | 2 154 497 | 9/1985 |

* cited by examiner

*Primary Examiner*—Scott A. Smith
*Assistant Examiner*—Nathaniel Chukwurah
(74) *Attorney, Agent, or Firm*—Kenyon & Kenyon

(57) ABSTRACT

A machine tool, in particular to a hand-operated hammer drill, having a compartment containing lubricant and a device for compensation of the pressure in the compartment in the area of a bearing of a component able to be driven so as to allow rotation. It is proposed that the bearing form at least a part of a lubricant seal of the pressure-compensation device via which a pressure in the compartment as able to be compensated.

12 Claims, 4 Drawing Sheets

MACHINE TOOL WITH A CHAMBER FOR LUBRICANT AGENT AND A PRESSURE EQUALIZATION DEVICE FOR SAID CHAMBER

FIELD OF THE INVENTION

The present invention is directed to a machine tool having a compartment containing lubricant and a device for compensation of the pressure in the compartment.

BACKGROUND INFORMATION

A machine tool forming the species, in particular a hand-operated hammer drill, is known from German Published Patent Application No. 42 31 987. The hammer drill has a driver motor, arranged within a motor compartment of a housing, having a motor shaft that extends through a housing section into a gear compartment, where it engages, via an integral pinion, with a gear unit for driving a tool-holding fixture. The gear compartment is provided with a pressure-compensation device that reduces a pressure, resulting during operation within the gear compartment, down to that of the atmosphere or of the motor compartment. The pressure-compensation device has a bore hole leading from the gear compartment to the outside or to the motor compartment and a rotary element, driven so that it is constantly rotating, in the form of a cover into which a passage is introduced.

SUMMARY OF THE INVENTION

The present invention is directed to a machine tool, in particular to a hand-operated hammer drill, having a compartment containing lubricant and a pressure-compensation device of the compartment in the area of a bearing of a component able to be driven so as to allow rotation.

It is proposed that the bearing form at least a part of a lubricant seal of the pressure-compensation device via which a pressure in the compartment may be compensated. Additional components, space, weight, assembly effort and costs can be saved. This can be achieved in a particularly inexpensive and uncomplicated manner in terms of design by using a lubricant seal implemented as a groove seal, which is arranged between the bearing and a bearing seat, it being possible to arrange the groove seal between an outer ring and/or an inner ring of the bearing and a bearing seat. Furthermore, it is conceivable that the lubricant seal, which is simultaneously usable for pressure compensation, is formed by a channel through the bearing, for example, a channel through a cage of a roller bearing and/or through bearing sealing washers fastened appropriately to the bearing.

In another embodiment of the present invention, it is proposed that the bearing and the bearing seat be formed of different materials having different coefficients of thermal expansion and that these be used to create the lubricant seal; specifically, it is beneficial that the bearing seat is formed of aluminum or an aluminum alloy and the bearing is formed of steel. If an outer bearing seat is formed of a material having a greater coefficient of thermal expansion than the bearing, as is beneficially the case for an aluminum bearing seat and a steel bearing, the bearing seat expands more when heated up and a gap between the bearing and bearing seat is created that may beneficially be used as a groove seal. Other material combinations that appear suitable to one skilled in the art are also conceivable in place of an aluminum-steel combination.

In this context, to prevent an undesired rotary movement of the bearing within the bearing seat, it is beneficially fixed in position in the circumferential direction within the bearing seat. This may be accomplished using various non-positive fit, positive fit and/or integral connections, for example, via a pin connection, a spring/groove connection and/or a positive-fit connection, in that an outer ring of the bearing has an outer contour that deviates from a round outer contour, etc. If the bearing is implemented as a locating bearing, and a component fixing the bearing in position in an axial direction is used to fix the bearing in position in the circumferential direction, additional components, space and assembly effort may advantageously be saved. For example, this can be achieved using a clasping component that holds the bearing in position in an axial direction, is torsionally fixed and has a projection that engages in a recess of an outer ring of the bearing.

In another embodiment of the present invention, it is proposed that a pressure-compensation channel be introduced into a bearing surface of the bearing and/or into a bearing surface of the bearing seat. A beneficial cross-section for the pressure compensation may be achieved with simplicity of design, and simultaneously a groove seal and/or labyrinth seal may be realized. The pressure-compensation channel in this case may be implemented, for example, in the form of an axial groove in a shaft, in an inner ring of a roller bearing, in an outer ring of a roller bearing and/or in a component forming an outer bearing seat, etc.

If the pressure-compensation channel is at least partially formed by a threaded-type recess, a beneficial labyrinth effect or labyrinth seal and, in addition, a recirculating effect may be achieved, which is done by coordinating the direction of threading and direction of rotation with each other. The threaded-type recess may in turn be introduced into the bearing and/or into a bearing seat. If the pressure-compensation channel opens through into at least one annular groove, it may be produced especially simply and economically, for example in one lathe operation, starting from a first annular groove and opening through into a second annular groove.

A filter element is beneficially connected in series with the lubricant seal formed at least partially by the bearing. While simultaneously ensuring the pressure compensation function, the sealing effect can be improved. A felt gasket, which can be manufactured especially economically and has proven beneficial characteristics, is especially suitable as a filter element. The felt element may be formed by various fibrous materials deemed appropriate by one skilled in the art, in particular such as animal hairs, plant fibers and/or synthetic fibers, etc. In order to save on additional holding components, the filter element is beneficially held in position by a component that holds a bearing in place.

Furthermore, in a space-conserving design, a beneficially large filter volume can be achieved, in that at least two radial pressure-compensation channels branch off from the bearing, and in particular in that the bearing is surrounded by an annular filter element, and the pressure-compensation channels open out from the bearing radially outwardly at the filter element.

The design approach of the present invention may be used in all machine tools deemed suitable by one skilled in the art, in particular in hand-operated machine tools, for example, grinders, saws, milling cutters, planers, drills, chisel hammers, etc.

DETAILED DESCRIPTION

Figure 1:
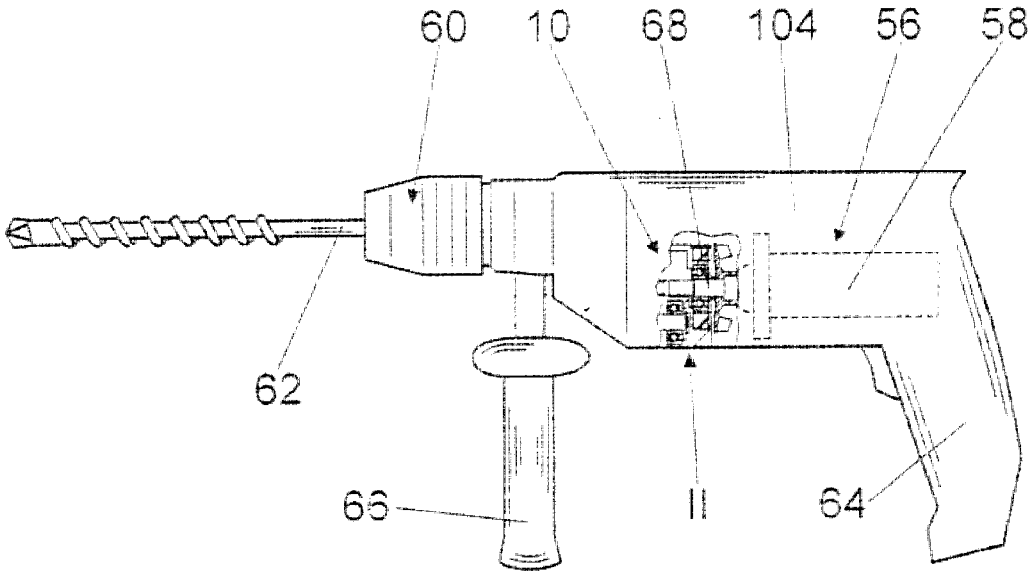
FIG. 1 shows a schematically illustrated hammer drill from the side.

FIG. 1 shows a schematically illustrated hammer drill having a housing 104 in which a drive motor 58 is supported within a motor compartment 56. A tool holder 60 and a drill bit 62 secured in tool holder 62 are able to be driven by drive motor 58, via a gear unit (not shown) arranged within a gear compartment 10, in a manner allowing rotation and striking. The hammer drill may be guided using two hand grips 64, 66 that extend essentially perpendicular to an operating direction, one handgrip 64 on a side facing away from bit 62 being integrally molded onto housing 104, and one handgrip 66 on a side facing drill bit 62 being fastened to housing 104.

Figure 2:
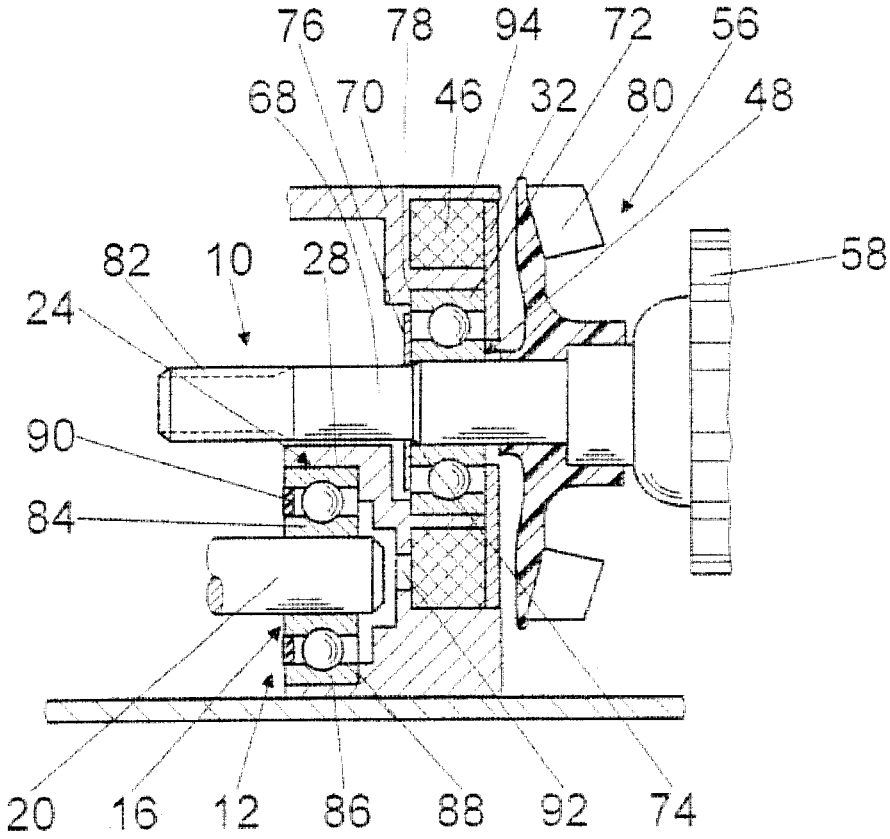
FIG. 2 shows a section of FIG. 1 marked "II".

Drive motor 58 has a drive shaft 68 on which a fan impeller 80 is arranged in a torsionally fixed manner within motor compartment 56 (FIG. 2). Drive shaft 68 projects from motor compartment 56 through a partition wall 70 made of aluminum into gear compartment 10 and is mounted in partition wall 70 so that it is able to rotate within a ball bearing 48.

An outer ring 72 of ball bearing 48 is connected by a press-fit to partition wall 70, and its inner ring 74 is connected in a rotatably-fixed manner to drive shaft 68 by a press-fit. Ball bearing 48 is implemented as a locating bearing, and specifically it is supported axially in the direction of gear compartment 10 against a shoulder 78 in partition wall 70, and is axially supported in the direction of motor compartment 56 against a retaining ring 32 affixed in partition wall 70. Gear compartment 10, filled with lubricant, is sealed airtight and lubricant-tight at ball bearing 48 via a sealing washer 76 in the direction of motor compartment 56.

Integrally molded on one end of drive shaft 68 projecting into gear compartment 10 is a pinion 82 via which drive shaft 68 meshes with a gear wheel (not shown) arranged in a rotationally fixed manner on an intermediate shaft 20 of the gear unit. Intermediate shaft 20 is rotationally mounted via a ball bearing 16 in partition wall 70. Ball bearing 16 is implemented as a locating bearing, and specifically is axially supported in the direction of motor compartment 56 against a shoulder 88 in partition wall 70, and is axially supported in the direction of gear compartment 10 by a retaining element (not shown) that is fastened in partition wall 70.

According to the present invention, ball bearing 16 forms a part of a lubricant seal 24 of a pressure-compensation device 12 via which the pressure in gear compartment 10 is able to be equalized, that is, a buildup of pressure in gear compartment 10 due to heating during operation of the hammer drill may reliably be prevented. Ball bearing 16, with its inner ring 84, is connected in a rotatably-fixed manner to intermediate shaft 20 by a press-fit.

Moreover, ball bearing 16 is mounted, with its steel outer ring 86, via a sliding fit in a bearing seat 28 formed by partition wall 70. Then the hammer drill is operated, ball bearing 16 and partition wall 70 heat up. Because of their differing coefficients of thermal expansion, partition wall 70 made of aluminum expands to a greater extent than ball bearing 16 made of steel. Between outer ring 86 of ball bearing 16 and partition wall 70 there arises a gap that functions as lubricant seal 24 or as a groove seal of pressure-compensation device 12, via which a pressure is able to be equalized. A bearing gap between inner ring 84 and outer ring 86 of ball bearing 16 is sealed airtight and lubricant-tight by a sealing ring 90.

To prevent an undesired rotary movement of outer ring 86 of ball bearing 16 within partition wall 70, the outer ring is connected in the circumferential direction in a rotatably-fixed manner by a positive-fit connection to partition wall 70 via the retaining element axially holding ball bearing 16 in position in the direction of gear compartment 10.

A filter element 46 formed by a felt ring is connected in series with the groove seal created between outer ring 86 and partition wall 70. Filter element 46 is placed in a recess 94 in partition wall 70, the recess surrounding ball bearing 48 in a ring shape, and is held in its place by retaining ring 32. Introduced into partition wall 70, coaxially with respect to intermediate shaft 20, is a bore hole 92 that is covered in the direction of motor compartment 56 by filter element 46 and via which a pressure difference between gear compartment 10 and motor compartment 56 may be equalized.

Figure 3:
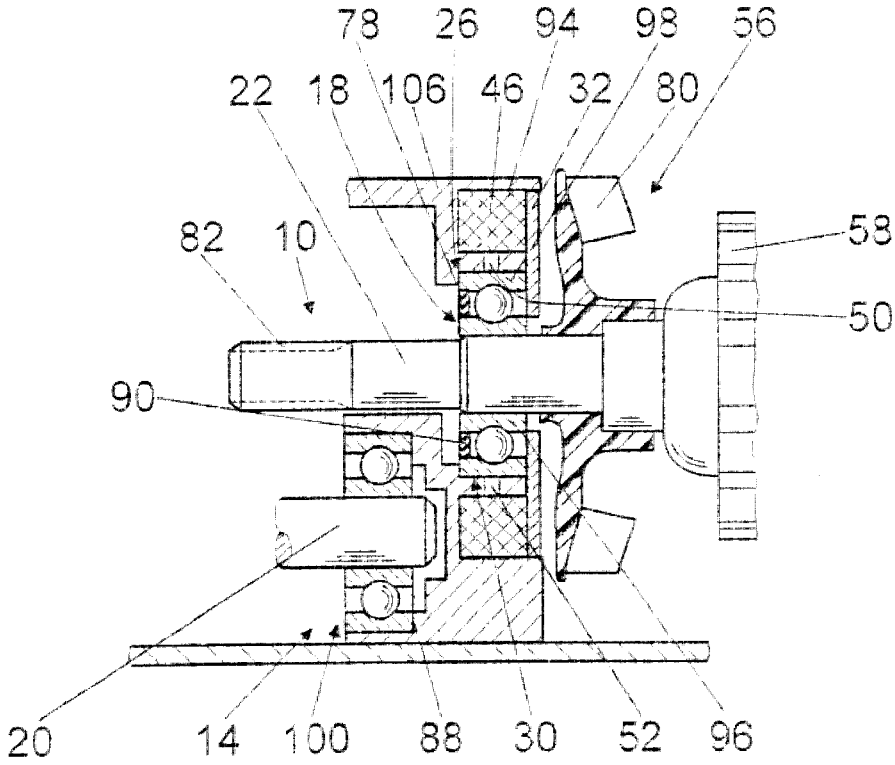
FIG. 3 shows a variant of FIG. 2 having pressure compensation channels running radially outwardly.

FIG. 3 shows one variant of FIG. 2 having a pressure-compensation device 14. Components that essentially remain the same are always numbered using the same reference numbers in the illustrated exemplary embodiments. Moreover, concerning features and functions that remain the same, refer to the description for the exemplary embodiment in FIGS. 1 and 2. The following description is essentially limited to the differences from the exemplary embodiment in FIGS. 1 and 2.

A drive shaft 22 of a drive motor 58 is supported via a ball bearing 18 in a partition wall 106. Ball bearing 18, according to the present invention, forms a part of a lubricant seal 26 of pressure-compensation device 14 via which the pressure in a gear compartment 10 is able to be compensated. Ball bearing 18, with its inner ring 96, is connected in a rotatably-fixed manner by a press fit to drive shaft 22. Moreover, ball bearing 18, with its steel outer ring 98, is mounted via a sliding fit in a bearing seat 30 formed by partition wall 106. When the hammer drill is operated, ball bearing 18 and partition wall 106 heat up. Because of their differing coefficients of thermal expansion, partition wall 106 made of aluminum expands to a greater extent than ball bearing 18 made of steel. Between outer ring 98 of ball bearing 18 and partition wall 106 there arises a gap that functions as a lubricant seal 26 or as a groove seal of pressure-compensation device 14 via which a pressure is able to be compensated. A bearing gap between inner ring 96 and outer ring 98 of ball bearing 18 is sealed airtight and lubricant-tight via a sealing ring 90.

To prevent an undesired rotary movement of outer ring 98 of ball bearing 18 within partition wall 106, the outer ring is connected in the circumferential direction in a rotatably-fixed manner by a form-fitting connection to partition wall 106 via a retaining ring 32 which axially holds ball bearing 18 in position in the direction of gear compartment 10.

A filter element 46 formed by a felt ring is connected in series with the groove seal created between outer ring 98 and partition wall 106. Filter element 46 is placed in a recess 94 in partition wall 106, the recess surrounding ball bearing 18 in a ring shape, and is held in its place by retaining ring 32. Extending from outer ring 98 of ball bearing 18 are four radial pressure-compensation channels 50, 52 which are distributed evenly over the periphery, are introduced into partition wall 106 and open out radially outwardly at filter element 46.

An intermediate shaft 20 of a gear unit (not shown) in gear compartment 10 is supported via a ball bearing 100 in intermediate wall 106. Partition wall 106 is sealed off, in the area of ball bearing 100, from gear compartment 10 in the direction of motor compartment 56.

Figure 4:
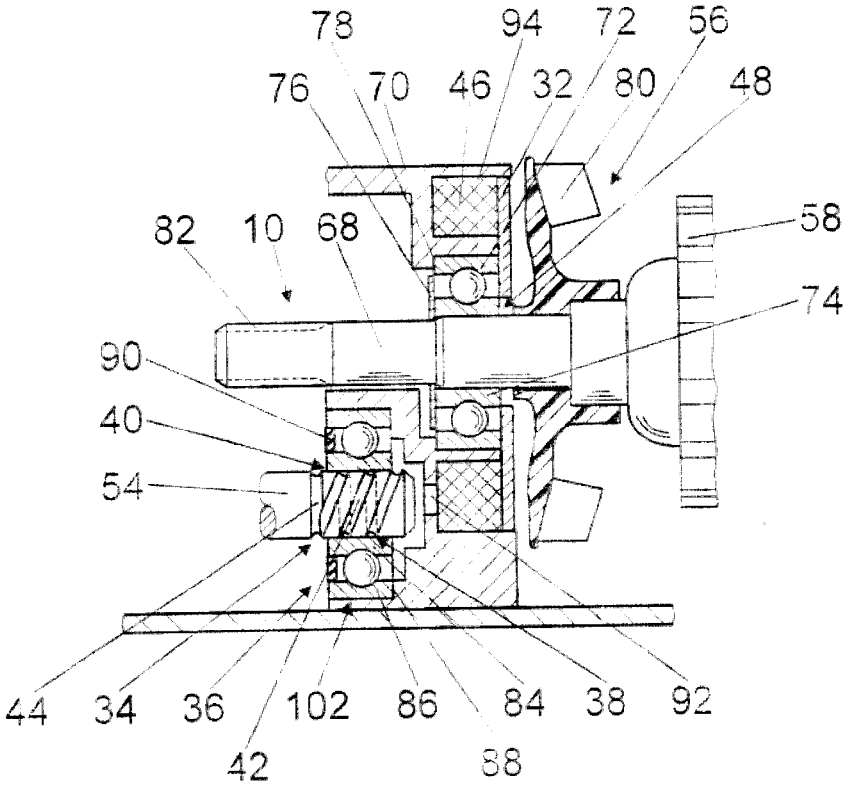
FIG. 4 shows a variation of FIG. 2 having a threaded-type pressure-compensation channel.

In an exemplary embodiment in FIG. 4, an intermediate shaft 54 is rotationally mounted via a ball bearing 36 in a partition wall 70. Ball bearing 36, according to the present invention, forms a part of a lubricant seal 38 of a pressure-compensation device 34 via which the pressure in a gear compartment 10 is able to be compensated. Ball bearing 36, with its inner ring 84, is arranged in a rotatably-fixed manner on a bearing seat 40 of intermediate shaft 54 by a press fit. Moreover, ball bearing 36, with its steel outer ring 86, is mounted via press fit in a bearing seat 102 formed by partition wall 70.

Introduced into a bearing surface of bearing seat 40 is a pressure-compensation channel 42, formed by a threaded-type recess that opens through, counter to a venting direction of gear compartment 10, into an annular groove 44. Pressure-compensation channel 42 forms a labyrinth seal and, in addition, has a lubricant-recirculating effect during operation. A bearing gap between inner ring 84 and outer ring 86 of ball bearing 36 is sealed airtight and lubricant-tight via a sealing ring 90.

List of reference numerals

10 compartment
12 pressure-compensation device
14 pressure-compensation device
16 bearing
18 bearing
20 component
22 component
24 lubricant seal
26 lubricant seal
28 bearing seat
30 bearing seat
32 component
34 pressure-compensation device
36 bearing
38 lubricant seal
40 bearing seat
42 pressure-compensation channel
44 annular groove
46 filter element
48 bearing
50 pressure-compensation channel
52 pressure-compensation channel
54 component
56 motor compartment
58 drive motor
60 tool holder
62 bit
64 hand grip
66 hand grip
68 drive shaft
70 partition wall
72 outer ring
74 inner ring
76 sealing washer
78 shoulder
80 fan impeller
82 pinion gear
84 inner ring
86 outer ring
88 shoulder
90 sealing ring
92 bore hole
94 recess
96 inner ring
98 outer ring
100 ball bearing
102 bearing seat
104 housing
106 partition wall

What is claimed is:

1. A machine tool, comprising:

a housing including a compartment containing a lubricant and a pressure-compensation device via which a pressure in the compartment is able to be compensated, wherein:

the pressure-compensation device includes a lubricant seal, and a bearing of a component able to be driven to allow rotation forms at least one part of the lubricant seal.

2. The machine tool according to claim 1, wherein:

the machine tool is a hand-operated hammer drill.

3. The machine tool according to claim 1, wherein:

the lubricant seal includes a groove seal arranged between the bearing and a bearing seat.

4. The machine tool according to claim 3, wherein:

the bearing and the bearing seat are formed of different materials having different coefficients of thermal expansion, and the bearing and the bearing seat form the lubricant seal.

5. The machine tool according to claim 4, further comprising:

a component for holding the bearing in position in an axial direction and in a circumferential direction, wherein: the bearing is a locating bearing.

6. The machine tool according to claim 5, further comprising:

a filter element connected in series with the lubricant seal.

7. The machine tool according to claim 6, wherein:

the filter element is an annular filter element that surrounds the bearing, and at least two radial pressure-compensation channels open out from the bearing radially outwardly at the filter element.

8. The machine tool according to claim 6, wherein:

the filter element is held in a position thereof by the component holding the bearing in position in the axial direction and in the circumferential direction.

9. The machine tool according to claim 3, wherein:

at least one of a bearing surface of the bearing and a bearing surface of the bearing seat includes a pressure-compensation channel.

10. The machine tool according to claim 9, wherein:

the pressure-compensation channel is formed at least partially by a threaded-type recess.

11. The machine tool according to claim 10, wherein:

the pressure-compensation channel opens through into at least one annular groove.

12. The machine tool according to claim 1, wherein:

at least two radial pressure-compensation channels branch off from the bearing.

* * * * *